United States Patent [19]

Rejto

[11] 4,238,190

[45] * Dec. 9, 1980

[54] SIMULTANEOUS TRANSFER PRINTING AND EMBOSSING OR SURFACE TEXTURING METHOD

[76] Inventor: Thomas Rejto, 19 Homestead Rd., Greenwich, Conn. 06830

[ * ] Notice: The portion of the term of this patent subsequent to Sep. 20, 1994, has been disclaimed.

[21] Appl. No.: 942,970

[22] Filed: Sep. 18, 1978

Related U.S. Application Data

[63] Continuation-in-part of Ser. No. 797,542, May 16, 1977, which is a continuation of Ser. No. 759,887, Jan. 17, 1977, Pat. No. 4,049,374, which is a continuation-in-part of Ser. No. 597,562, Jul. 21, 1975, abandoned.

[51] Int. Cl.[3] ..... D06P 5/00

[52] U.S. Cl. ..... 8/471; 8/489; 8/491; 156/219; 428/914

[58] Field of Search ..... 8/2.5 A, 17; 428/914, 428/913

[56] References Cited

U.S. PATENT DOCUMENTS

| | | | |
|---|---|---|---|
| 2,370,186 | 2/1945 | Oldofredi | 101/28 |
| 2,549,847 | 4/1951 | Oldofredi | 101/127 |
| 2,681,612 | 6/1954 | Reimann | 101/25 |
| 3,458,335 | 7/1969 | Newman | 428/195 |
| 3,860,388 | 1/1975 | Haigh | 8/2.5 A |
| 3,868,214 | 2/1975 | Shackleton | 8/2.5 A |
| 4,018,066 | 4/1977 | Fennekels et al. | 8/2.5 A |
| 4,049,374 | 9/1977 | Rejto | 8/2.5 A |
| 4,059,471 | 11/1977 | Haigh | 8/2.5 A |
| 4,111,646 | 9/1978 | Buckwalter et al. | 2.5 A/ |
| 4,138,945 | 2/1979 | Rejto | 8/2.5 A |
| 4,171,202 | 10/1979 | Sideman et al. | 8/2.5 A |

FOREIGN PATENT DOCUMENTS 1432197 4/1976 United Kingdom .

*Primary Examiner*—A. Lionel Clingman

[57] ABSTRACT

This invention relates broadly to the simultaneous heat transfer printing or transfer dyeing and embossing or surface texturing of fabrics or other relatively flat materials containing thermoplastic fibers or other thermoplastic components or finishes.

More particularly, the invention provides a process for such simultaneous printing and embossing or surface texturing in which the heat transfer pattern printed or otherwise deposited in sublimable or vaporizable dye on a printing-embossing sheet can be transferred to one or several materials without being substantially affected by the embossing.

The invention also provides an embossing means for use in that process; and an apparatus to implement it.

28 Claims, 8 Drawing Figures

SIMULTANEOUS TRANSFER PRINTING AND EMBOSSING OR SURFACE TEXTURING METHOD

The present Application is a continuation-in-part of my co-pending Application Ser. No. 797,542 filed May 16, 1977 which is a continuation of my Application Ser.No. 759,887 filed Jan. 17, 1977, issued Sept. 20, 1977, U.S. Pat. No. 4,049,374 which is a continuation-in-part of Ser. No. 597,562 filed July 21, 1975; abandoned.

BACKGROUND OF THE INVENTION

It is already known to produce decorated fabrics by exposing them to a sheet or web of transfer material, such as a smooth sheet or web of paper, carrying a vapourizable or sublimable dyestuff. By the application of heat to the transfer means when pressed against the fabric, the dyestuff is caused to migrate to the fabric in vapour form, and there is produced on the fabric a reverse replica of the pattern in which the dyestuff was laid down on the transfer means, (usually paper). The heat and pressure employed in the process, however, render the surface of the fabric smooth and slippery, making the fabric undesirable for many uses, for example in certain kinds of clothing and upholstery for furnishings. One cause of this effect is that the heat transfer operation is carried out at a temperature reaching the softening point of the thermoplastic fibres. I have discovered, as is disclosed in my copending Application No. 797,542 that this undesirable slipperiness of the printed fabric may be avoided by using an embossing means to impart a surface texture to the fabric, at the same time as the sublimable or vapourizable dye is transferred thereto in order to print it. In particular I have disclosed in that copending application a process in which the embossing element is interposed between the transfer paper and the fabric during the application of heat and pressure, and in whcih the embossing member is made of a porous material such as fibreglass which can let through the major portion of the sublimating dyestuff. With that process there is obtained on the fabric an embossing or surface texturing effect practically without any change in the design of the transfer sheet as printed on the fabric by the sublimable dyestuff. This is in contra-distiction to a process in which the material of the embossing means has substantial retention properties and/or an affinity for such dyestuff, so that the dyestuff reaches the fabric only through the perforations provided in the embossing means to define the embossing pattern therein, and hence colours only the portions of the fabric opposite those perforations. In such a process the dyestuff actually appears, therefore, on the fabric in a pattern which is a subtractive combination of the pattern in which the dyestuff is present on the transfer paper with the three dimensional pattern on the embossing sheet. Usually, moreover, the embossing member which may be a lace, crochet work or other openwork fabric, is itself "printed" or soiled with the dye during the transfer operation and can be used only once, unless a cleaning operation is performed on it. Such a process is therefore usually restricted in its application to the preparation of coordinated fashion items wherein the lace or crochet work used as a stencil or embossing means and the printed and embossed fabric can both be utilized as end product fabrics.

DESCRIPTION OF THE INVENTION AND OUTLINE OF THE DRAWINGS

According to the present invention there is provided a method according to Application No. 797,542 of printing in colour onto a thermoplastic fabric a replica of a first pattern and of simultaneously embossing in relief into that fabric a second pattern without substantially affecting the first pattern as so printed, said method comprising the steps of (a) superposing i. a heat transfer printing means bearing a vapourizable or sublimable dye according to said first pattern, the dye having a high affinity for said thermoplastic fabric;

ii. an embossing sheet or web, the material of which is permeable to said dye but has practically no affinity or retention properties for said dye, said embossing means having in both faces or at least in the face thereof remote from the transfer printing means, a design in relief according to said second pattern, said relief being created by alternation of raised and hollow portions and/or by apertures in the embossing surface, and iii. a thermoplastic fabric;

(b) applying heat and pressure to the superposed members to cause the transfer by migration of the dye through the material of the embossing means and into the thermoplastic fabric and also to cause reproduction in the latter, in relief, of said second pattern, and (c) separating said members one from another.

The dyestuff may be a dispersible or cationic dyestuff, vapourizable or sublimable at a temperature which is lower than the melting point of the material to be printed. It should have a high affinity for all or some thermoplastic manmade fibres such as polyesters, polyamides, acrylics, modacrylics and others. It should have no affinity for the constituents of the embossing means. It should usually have a strong migrating and penetrating power in order to be able to pass through the embossing sheet and to penetrate sufficiently into the material to be printed. While low energy dispersible dyestuffs seem theoretically the most suitable, some medium and high energy dispersible dyestuffs and some cationic and other dyestuffs may also give satisfactory results.

The surface texturing or embossing means should be made of materials having practically no affinity or retention properties for dyestuffs of the above described categories. Such materials include: fibre glass, rayon, cotton and other cellulosic derivatives or silk for example, and also binders having similar properties. These materials are permeable to vapourized or sublimated dyestuffs of the above-described types. The embossing means may be a non-woven sheet or web or of woven knitted, crocheted, braided or other construction. It may be foraminous and will have at least one face with a non-flat, textured surface exhibiting a three-dimensional pattern. That three-dimensional pattern will determine the pattern of the three-dimensional effect obtained in the material being printed and embossed. Embossing means with apertures have by their very nature a three dimensional pattern at both faces.

The invention will now be further described in terms of some presently preferred modes of practice of the process thereof and in terms of some presently preferred embodiments of the embossing means thereof and with reference to the accompanying drawings in which.

Figure 5:
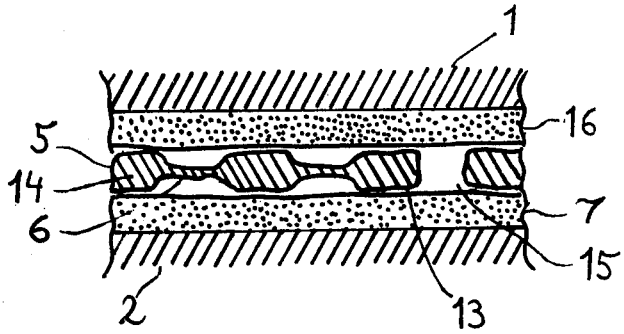
Figure 6:
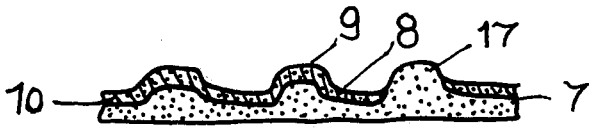
Figure 7:
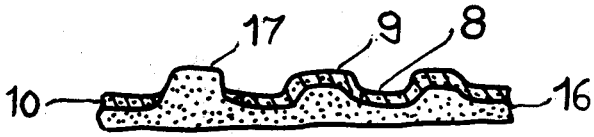
Figure 8:
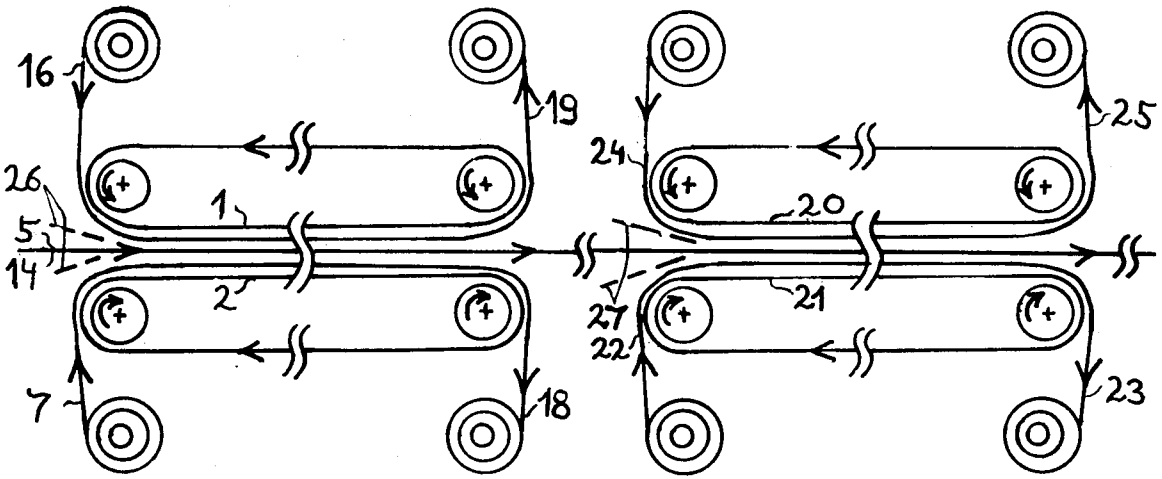

FIGS. 5, 6 and 7 are equally fragmentary cross sections, at an enlarged scale. They illustrate another variant of the process of the invention which uses a single element printing and embossing means capable of printing and embossing two fabrics simultaneously and, FIG. 8 is a schematic representation of an apparatus which can carry out continuously the simultaneous printing of two fabrics and repeat the same operation once or several times by reusing the original single element printing and embossing means.

Figure 1:
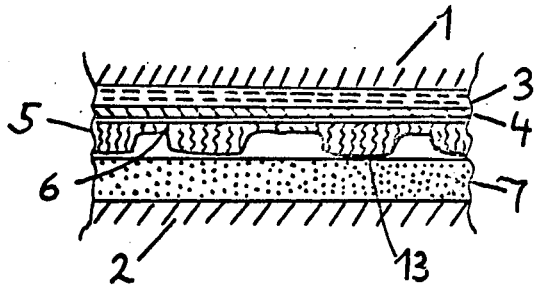
FIG. 1 is a fragmentary cross section, at an enlarged scale, of a fabric in superposed relation to the other elements, including the novel embossing sheet or web of the invention, by means of which the process of the invention is performed on the fabric.

Referring to FIG. 1, a heat transfer printing means 3, for example of paper, bearing on one face a coating 4 of a vaporizable or sublimable dyestuff, an embossing or texturing member 5, and a material 7 to be printed and embossed, are all in sheet or web form and are disposed in superposed stacked relation between relatively movable press members 1 and 2 of a transfer apparatus. The embossing member 5 lies between the coated side of the transfer printing means 3 and the material 7.

The material 7 may for example be a white polyester fabric. The coating 4 defines a first pattern to be printed on the fabric 7 by migration of the dye as a gas or vapour from the coating 4 through the element 5 and into the fabric 7. The coating 4 may however be uniform over the surface 3.

The member 5 bears on the face thereof turned toward the material 7 a second pattern which is, however, a three-dimensional pattern, i.e. a pattern in relief, and not a pattern in colour or of light and dark. This second pattern is indicated in the drawing by the indentations or hollows 6.

One or both of the members 1 and 2 of the transfer apparatus including means, not shown in the drawing, for the delivery of heat to the stack of elements 3, 5 and 7. Thus at least one member may include conduits for the circulation of a heated fluid therethrough, or may bear electric resistances.

The embossing means 5 may be either of non-woven or of woven, knitted, crocheted, braided or other construction, of a material such as fibre glass, rayon, cotton or some other cellulose derivates, or silk, optionally with a suitable binder or binders (especially if the material is non-woven). Suitable binders for example are polyvinyl alcohol, polyvinyl pyrrolidone, and carboxy methyl cellulose. For example the element 5 may be of bundled, bonded or spun-laced rayon non-woven fabric, made from staples by a dry or wet process and having a textile like apsect with different pattern possibilities including patterns imitating open work fabrics. It is permeable to vapourized or sublimated dyestuffs and is without affinity therefor. In particular the element 5 is permeable to such dyestuffs over the whole surface thereof, substantially independently of the three-dimensional pattern thereon, i.e. the second pattern above referred to. The embossing means is permeable to the dye vapour or gas not only due to the material of which it is made but also to the construction thereof, which is sufficiently loose and porous to permit ready passage of the dye vapour or gas between the filaments. Thus the element 5 is permeable to the dyestuff at the full thickness portions 13 thereof as well as at the reduced thickness portions thereof indicated by the hollows 6. The embossing means 5 must of course be able to withstand, without melting and preferably without softening, the temperatures employed in the process of the invention, which as below indicated may for example be of the order of 200° C.

The pattern on the embossing means may comprise for example a rectangular array of, say 50 square depressions or hollows per square centimeter resembling in miniature the appearance of a waffle.

As said, the sheet or web 3 may be of paper. An example of a suitable material for the coating 4 is an ink containing 6% of disperse red 4 (colour index number 60755 in the 1976 Buyers Guide to U.S. Producers and Suppliers of Dyes, Pigments and Chemical Specialities for the Wet Processing Industries, published by the American Association of Textile Chemist and Colourists). Disperse Yellow 4 and Disperse Blue 14 and 3 are also good examples of penetrating dyes.

The layers 3, 5 and 7 of the stack are then pressed together and heated by the press, for example to a temperature of about 200° C. for a period of 30 seconds. The temperature can be considerably lower or higher and the time period much shorter or longer. The pressure may vary widely according to circumstances, and may for example be in the range of 0.07 Kg to 3.5 Kg per square centimeter. (Even 0.002 Kg can be sufficient in some cases.) Upon removing from the transfer apparatus and separating the layers of the stack, the major part of the dyestuff will have migrated to the fabric 7 through the embossing means 5, without notably soiling or colouring the latter. The fabric 7 is permanently dyed red (in the case of the dye above suggested as an example), and in a reverse replica of the pattern in which the coating 4 appeared on the transfer sheet 3. It is also permanently textured, on the dyed face thereof which was adjacent to the sheet or web 5 during the pressing and heating step. Thus, if the pattern on the embossing means is the rectangular array of depressions above described, the embossed material will have a "hand" comparable to that of a woven fabric with a basket weave pattern. Moreover the replica on the fabric 7 of the pattern of the dye 4 is substantially unaffected by the pattern in relief now also present on the fabric sheet or web 7.

Figure 2:
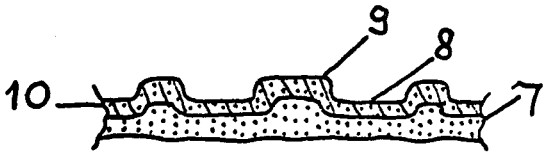
FIG. 2 is a similar cross section of the fabric after performance of the process.

The resultant dyed and textured fabric 7 is illustrated diagrammatically in enlarged cross section in FIG. 2, where reference character 9 identifies the raised portions corresponding to the hollows 6 in sheet or web 5, reference character 8 identifiying the resulting hollows in the surface of the fabric, and reference character 10 identifying the layer or portion of the thickness of the fabric permeated by the dye.

Other suitable dyestuffs for use in the process of the invention, are Disperse Blue 134 and Disperse Yellow 54, also identified in the above-cited publication. Blends of the cited dyes may also be employed.

According to one modification of this method the pattern of colour (or of light and dark) produced by the sublimable dye on the transfer paper may be modified, as transferred to the fabric to the dyed and textured, by inclusion in the embossing means of a dye trap, either in a continuous coating or according to a third pattern. An emulsion or solution containing an acrylic resin or other products with dye retention or dye repellent properties may be used for this purpose.

It is also possible to create a dye-trap containing a dyestuff of which a limited portion will transfer onto the fabric during the printing. The dye trap can also be constituted by the introduction into the emmbossing means of fibres which retain the dyes used in transfer printing.

Figure 3:
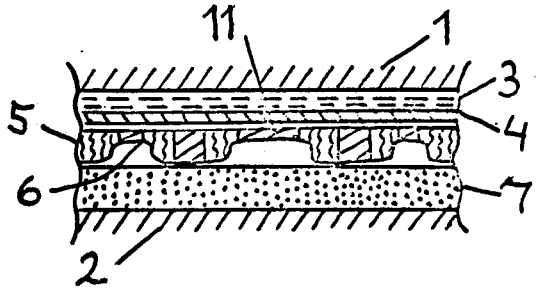
FIGS. 3 and 4 are fragmentary views respectively similar to FIGS. 1 and 2 but illustrating a variant form of the process of the invention and of the embossing means of the invention.
Figure 4:
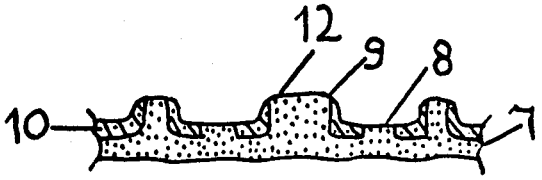

FIGS. 3 and 4 illustrate diagrammatically this process according to the invention, the embossing means employed therein, and the resulting dyed fabric. The elements of structure in FIG. 3 are the same as those bearing corresponding reference characters in FIG. 1, except that in FIG. 3 the embossing means 5 includes areas 11, further identified by hatching lines extending diagonally from upper right to lower left, impregnated with a dye trap as above described. During the simultaneous application of heat and pressure to the stack, as described in connection with FIGS. 1 and 2, these portions 11 of the sheet or web 5 absorb and hold the dye, so that the adjacent portions of the fabric 7 are undyed in the final product, as indicated at 12 in FIG. 4.

If a dyetrap with partial dye absorbtion is used, or if the embossing means is foraminous, a part of the dye will transfer onto the fabric. The corresponding parts of the fabric will however have a lighter colouration.

It is possible to obtain different colour combinations with the same transfer paper by depositing dyes on the embossing means before the transfer printing operation. The dye of the embossing means will migrate into the fabric to be printed and embossed at the same time as the dyestuff which is migrated from the transfer paper. Thus it is possible to obtain on the fabric, with the help of a transfer paper bearing for example red flowers on a white ground: flowers of a modified red on bases of different colours. It is also possible to deposit on the embossing means complementary motifs and so obtain different designs with the same transfer paper. The dyestuff may be replaced or supplemented by some finishing products which if deposited onto the embossing means will transfer during the heat transfer printing process onto the fabric.

The dyestuff to be used on the embossing sheet has to be of the same nature as those previously mentioned. However, it is not necessary to use dyes with high migration and penetration strength.

Another variant makes it possible to obtain with the transfer paper, printed with a one colour pattern (which might be a uniform colouration across the whole surface), designs composed of several colours on the printed fabric. In order to obtain such a result the colour deposited on the transfer paper has to be a blend of high penetration and low penetration dyes. If a foraminous embossing means—made of a material letting through only the high penetration dye—is used, both components of the dye will pass through the openings while only one will migrate through other areas. If dye traps are incorporated into the embossing screen, white or light areas will also appear on the printed fabric facing the corresponding traps. More than one colour can be used on the transfer paper and dyes with different penetration strength can be also used side by side. When this variant of the process is used the dye migration from the transfer paper will not be uniform during the first printing, as the low penetration dye will be able to migrate only in places facing openings. So a second print can be made with the same transfer paper (without the use of an embossing means). The design obtained during the second print will be lighter and will correspond to the negative image of the first printing.

Another important variant makes use of an embossing means having on both of its faces a non-flat, textured surface. (Foraminous sheets are included in this group). Moreover, said embossing means acts in the meantime as a transfer printing means as the dye is deposited directly onto or into said sheet or web. In this variant it is not obligatory to use an embossing means letting through the gazeous or vapourised dye, nor is it obligatory to use a high-penetration dyestuff, unless colour is to be deposited on one face only of the single element embossing printing means while the printing can, amazingly, be carried out by the other face or by both faces.

Some convenient low penetration dyes which can be used when high penetration is not required are: Disperse Red 55, Disperse Yellow 42, Disperse Blue 56 and 26.

The use of a single element (or "unitary") embossing and transfer printing means, having two textured faces makes possible and simultaneous printing end embossing of two materials (for example fabrics), one being placed under and the other over the described sheet.

Moreover, if the sheet or web is made of an absorbent material and a sufficient quantity of dye is deposited into or onto the sheet or web the operation can be repeated several times without dye addition, surprisingly without a notable change of the final result. Up to 10 successive printings where made in semi-industrial trials.

The dye deposit into the single element embossing-transfer printing means can be done by padding in a dye bath or by other means. The use of a solvent can be helpful.

In order to get better results, a drying of the padded or otherwise coloured embossing-printing element is normally necessary.

It might be necessary to eliminate excess dyestuff; This can be done, for example, by making a first printing on a low cost and preferably reusable material. It might also be necessary to improve the uniformity of distribution of the dye particles throughout the surface of the embossing-printing sheet or inside the areas where colours were deposited. Among other methods of levelling, the passing of said sheet between two heated elements—for example steel or teflon coated rollers heated to approximately 210° C. gives unexpected good results. The heated elements may be of other shape or nature but will be made in any case preferably in a material having little or no affinity or permanent retention properties for the used dyes.

If the process is carried out with the help of a single element printing and embossing sheet containing dye traps—which means that some areas have an affinity and retention properties for the dye used in the process—the printed materials will show corresponding lighter (or white) areas.

Among other materials, rayon non-wovens can be used with success as single element printing and embossing sheets for repeated double printings.

If necessary (for example to obtain multi-colour motives or fabrics with a coloured back) it is possible to also deposit dyestuffs onto or into the materials to be printed and embossed, prior to the execution of the process. The dye deposition can be made by the same methods as for the printing-embossing means and can use dyestuffs of the same nature.

During the heat transfer printing and embossing operation the said dyes will be fixed into or onto the material.

Reference will now be made to FIGS. 5, 6 and 7, in which references 1–13 indicate parts similarly referenced in FIGS. 1 to 4.

In FIG. 5 dyestuff 14, indicated by hatched lines, is deposited into the printing-embossing element 5 having a perforation 15. A second fabric 16 is to be simultaneously decorated.

FIGS. 6 and 7 show the printed and embossed fabrics 7 and 16 respectively. 17 identifies the non-coloured areas which faced, during the process, a perforation such as 15 of the single element printing-embossing means. As the perforation was—on purpose—placed out of centre in FIG. 5, the white area 17 appears at the opposite extremities of the fabrics 7 and 16. This is not the case if the perforations are symmetrical in the printing-embossing element.

FIG. 8 represents schematically a new type of heat transfer printing apparatus enabling the successful execution of a continuous transfer-printing and embossing operation on two materials at the same time, repetitively on several sets of materials (usually fabrics). The drawing represents only two printing-embossing stations but there can be many more similar stations. Heating means, pressure means, regulators and other details are not shown for clarity, but several suitable arrangements are known.

The first station has, as in the previous figures, moving (or movable) transfer members 1 and 2. In this type of transfer calender the transfer members generally used (for example and heated roller and an apron) are replaced by two endless belts made in a strong and heat resistant material. References 20 and 21 identify the corresponding members of the second printing-embossing station.

The parallel sets of endless belts, whose length can vary, make possible the transit of the single element printing-embossing sheet 5 into or onto which the colour 14 was already deposited, and the entry and exit, as well as the simultaneous transit, of two fabrics (or other materials) at each station. 7 and 16 represent the untreated fabrics entering at the first station; 22 and 24 those entering at the second station. The printed and embossed (or surface textured) materials leaving the first station are identified by 18 and 19, the decorated materials leaving the second station by 23 and 25.

The endless belts take care of the conveying of the materials, (i.e. the stack), of the transmission of the heat, and of the pressure. If they are made in a material having openings or an otherwise structured non-smooth surface they will impart a texture to the reverse side of the fabrics during the operation. If sublimable or vapourisable dye is deposited on them they can also colour the back of the fabrics. A pre-heating by laser beams, infra red, other radiant sources or other means of the embossing-printing web and of the adjacent faces of the fabrics to be decorated at the entrance of each station, accelerates the process and avoids the necessity of excessive heating inside the stations. This preheating system is diagrammatically indicated by radiation lines 26 at the first station and 27 at the second one.

Distance between stations can be determined case by case by the constructor and the small gap between upper and lower belts as well as the pressure to be imparted can be regulated in order to make it possible to process different materials, and even simultaneously to process and stack composed of several printing-embossing sheets and more than two fabrics at each station. Such processing of stacks composed by multiple layers can also be made on a press, preferably heated by both the upper and lower press plates. Protective paper can also be introduced if it is needed.

The fabric rolls will be placed at a convenient distance. The heat and speed can be regulated.

Supplementary devices are foreseen to feed in and to pick up the printing-embossing webs at each station in order to made possible the separate use of each station. This is particularly useful when the unitary printing-embossing means is made in a material having an affinity for the dyes used in the process. In this variant, which is also part of the invention, only the excess dye will transfer into the adjacent fabrics. The remaining dye will be permanently fixed into the printing-embossing element which can be for example a polyester lace. In this case the printing-embossing element will be usually used only once.

The apparatus can also function by treating only one fabric per station or it can use a separate transfer printing means and embossing means. In this case the transfer paper will enter in place of one of the fabrics.

Printing without embossing can also be executed with the apparatus as well as embossing without printing.

Moreover the possibility to print and/or emboss warped yarns also exists, and numerous other applications of the same machine are also possible. It must also be mentioned the the transit of the single element printing-embossing means through a station of the described special calender can take care of the dye levelling. If the apparatus is made of corrosion resistance material, the drying of the said unitary printing-embossing means can equally be made by the passage between the heated endless belts of a station.

If the single element printing-embossing means is made of a highly resistant material and thus can be reused for many cycles, it can be mounted as an endless belt. Colour will then be deposited continuously on this endless belt, which will be able to colour and emboss (or surface texture) two fabrics (or other thermoplastic materials) at once.

The different features of the invention can be executed as well on cut parts as on continuous materials; on special apparatus (for example the described apparatus), or on more or less modified apparatus already used in thermoprinting such as presses and calenders. Unexpectedly, if the fabric to be decorated is not too heavy, non modified classical apparatus heating the stack from one side only, gives acceptable results, even when a single element printing embossing sheet processes two fabrics simultaneously.

If a single element printing-embossing surface is used, the colours can be deposited into or onto said surface immediately before the simultaneous transfer printing and embossing operation, and even a continuous operation line can be erected. However, this is not essential and the deposition of the colour can be done earlier.

Among other variants and advantages it is worthwhile mentioning:

the possibility of combining together the transfer printing means and the embossing means by bonding them with a dye-permeable glue or by forming an embossing pattern on the transfer sheet by depositing on it a tri-dimensional pattern, with the help of coating rolls or printing rolls. The said relief-forming coating has to be in a material which lets through the dye vapours and gases.

the possibility of using a composite printing-embossing means consisting of more than one dye-vapour-permeable, preferably foraminous, single element printing-embossing sheet bearing different patterns in order to enable the creation, with the help of a limited number of such components, of a great variety of designs and textures on the material to be decorated. The simultaneous use of high and low penetration dyes enhances even farther the possibilities of this method, mainly if two fabrics are printed at the same time as illustrated in FIG. 5.

the possibility of using a single element printing-embossing sheet extending only over (and/or under) a portion of the fabric to be decorated.

the possibility of obtaining a deeper and more complete dye penetration onto the fabric than with any other sublimation-transfer-printing method. A porous, highly absorbent single element printing-embossing sheet, storing a significant quantity of dye (preferably a blend of low and high penetration dyes) has to be used. The process is preferably executed on an apparatus with a vacuum or suction system. Prolonged contact time, elevated heat and relatively high pressure improve the results even more.

The possibility of improving, by the described simultaneous printing-embossing process, the abrasion-resistance and the stability of knit fabrics, especially those made of spun and/or texturized polyester yarn, as well as of brushed fabrics and non woven fabrics. The use of a foraminous embossing or printing-embossing sheet, and the application of increased heat and pressure enhances the results.

The possibility of performing the process on goods containing an important proportion of natural fibers. In this case, executed with the help of a porous and absorbent single element printing-embossing sheet, dyestuff having affinity for the natural fibers to be colored is stored in the printing-embossing sheet together with the usually applied sublimable dye, and a wet transfer printing step is added to the dry transfer printing step. Both steps can be carried out, along with other possibilities, on the apparatus described in this application (FIG. 8). An after-treatment fom a better fixation of the color on the natural fibers and a washing or rincing operation to eliminate excess dye is usually necessary. The embossing or surface texturing effect diminishes with the increase of the proportion of non thermoplastic fibers.

An example of simultaneous heat-transfer printing and embossing of a polyester double knit is described hereinafter to better illustrate some important features of the present invention.

EXAMPLE

This example is executed by the static method on an air-pressure-actuated transfer printing press with heating elements in its upper and lower plates. A single element printing-embossing means is used and two fabrics are printed at the same time, one being placed under the other being placed over the printing-embossing sheet (as illustrated by FIG. 5).

The printing-embossing operation is repeated 5 times, using the same printing-embossing means; dye is not added between the successive printings. There is no significant difference in the coloration and in the surface texture obtained on any of the 10 decorated fabrics.

A sublimable disperse dye is used in the described example.

The fabric to be printed is a white 100% polyester "Ponte di Roma" double knit made in textured yarn of 150 denier. Its weight is 200 grs per square meter. It is previously scoured and heat-set.

The single element printing-embossing sheet is a web-laid-bundled-openwork-non woven fabric made of 100% rayon and reinforced with polyvinyl alcohol, a binder which does not obstruct the circulation of dye vapors and/or gases. ("Keybak" of Chicopee Manufacturing Company specially adapted to the needs of the present invention). Its weight is 50 grams per square meter. It has about 50 small square openings per square centimeter. The openings cover about 50 to 60% of the total surface. It is porous, easily penetrable by gases and vapors but has no significant permanent retention properties for sublimable and vaporizable dyes used in heat transfer printing of synthetic fabrics. It has hydrophilic and can absorb at least 4 times its own weight in liquid.

The dyestuff used in Disperse Red 55 (maximum commercial concentration). It is a sublimable disperse dye currently used in heat transfer printing. It has, particularly on polyester, good light/fastness, rubbing fastness, wash and dry cleaning fastness. It doesn't penetrate deeply into the fabric when applied by sublimation transfer.

Sodium lignosulphonate and oxyethylate castor oil (with about 33 molecules of ethylene oxide) are used as dispersing agents.

The operation is executed as follows:

An aqueous dye dispersion of 20% concentration is prepared.

The non-woven printing-embossing sheet is padded in this dye bath. Excess liquid is then eliminated by passing the sheet through a set of wringers so that 100 grams of liquid, containing 20 grams of dyestuff per square meter, remains.

The non woven sheet is then dried by hot air circulation.

The non-woven cloth, placed between two sheets of paper is then pressed in the transfer printing press for 15 seconds at a temperature of 210° C. whereby uniformity of distribution of the dye particles is improved. Excess dye particles are eliminated. The single element printing-embossing sheet is now ready to operate.

A stack, protected by two paper sheets and composed of two double-knit fabrics, with the printing-embossing sheet placed between them, is then pressed in the heat-transfer-printing press for 35 seconds at a temperature of 210° C. The indicated gauge pressure of the press is 1.75 kg/cm2.

During this operation less than 2 grams of dye is transferred onto each of the two fabrics.

After a short cooling period the stack is separated. The grid-like three dimensional image of the foraminous non-woven sheet is permanently reproduced on the fabrics in an intensive red color.

Contrary to the usual flat and slippery "hand" obtained in heat transfer printing, the product of this example acquires a permanent surface texture with a favorable "hand" comparable to that of a woven fabric with a basket weave pattern.

Successively four other stacks are made, and pressed under the same conditions as was the first one. The same printing-embossing sheet is used in all these operations. There is no significant difference in the coloration and in the texture obtained on the decorated fabrics.

The present invention will make it possible to use thermoprinting in many fields, among others men's wear, furnishing upholstery, automotive fabrics, where it could not succeed until now because of the usually smooth surface and slippery hand of transfer printed goods.

The described repetitive double transfer printing (or transfer dyeing) and embossing (or surface texturing) methods can moreover replace successfully not only other printing methods, but also, in many cases, piece dyeing.

I claim:

1. A method of printing in colour onto a thermoplastic fabric a replica of a first pattern and of simultaneously embossing in relief into that fabric a second pattern without substantially affecting the first pattern as so printed, said method comprising the steps of (a) superposing i. a heat transfer printing means bearing a vapourizable or sublimable dye according to said first pattern, the dye having a high affinity for said thermoplastic fabric;

ii. an embossing sheet or web, the material of which is permeable to said dye but has practically no affinity or retention properties for said dye, said embossing means having in both faces or at least in the face thereof remote from the transfer printing means, a design in relief according to said second pattern, said relief being created by alternation of raised and hollow portions and/or by apertures in the embossing surface, and iii. a thermoplastic fabric;

(b) applying heat and pressure to the superposed members to cause the transfer by migration of the dye through the material of the embossing means and into the thermoplastic fabric and also to cause reproduction in the latter, in relief, of said second pattern, and (c) separating said members one from another.

2. A method as claimed in claim 1, wherein dyestuff with strong volatility and high penetration strength is used over at least part of said transfer printing means, in order to migrate substantially completely through the embossing means.

3. A method as claimed in claim 1, wherein the thermoplasticity of the fabric to be printed is due, at least partially, to a thermoplastic finish or coating.

4. A method as claimed in claim 1, wherein the thermoplastic fabric, the embossing sheet or web and the heat transfer printing means are continuous flexible webs which are advanced together through a printing and embossing zone.

5. A method as claimed in claim 1, including the preliminary step of providing the embossing sheet or web with a dye trap according to a third pattern.

6. A method as claimed in claim 1, wherein said transfer printing means and said embossing sheet or web are bonded together.

7. A method as claimed in claim 1, wherein the embossing sheet or web contains a vapourizable or sublimable dye which also migrates into the thermoplastic fabric during the transfer printing operation, adding to it a supplementary colour and/or pattern.

8. A method as claimed in claim 7, wherein the embossing means contains, instead of or supplementary to the dye, a finishing product which is transferred onto the thermoplastic material during the heat transfer.

9. A method as claimed in claim 1, wherein the transfer printing means bears sublimable or vapourizable dyes of different colours or shades and of different penetration strength, side by side, or in a blend, and wherein the embossing sheet or web has portions letting through all colours while other portions let through only the high penetration dyes or none of the dyes, whereby the colours and designs obtained on the simultaneously embossed thermoplastic fabric are different and more diversified than those of the original transfer printing means.

10. A method as claimed in claim 9 wherein the once used transfer printing means is not exhausted at portions where it faced areas of the embossing means, which were impeding the migration of some of the dyes, and wherein it is reused for a second printing, and—if used without an embossing means—will transfer onto a second thermoplastic material the negative, somewhat lighter, image of the coloured pattern produced by the first transfer.

11. A method as claimed in claim 1, wherein said transfer printing means and said embossing sheet or web comprise a single element.

12. A method as claimed in claim 11, wherein the single element printing-embossing means has a pattern in relief in opposed faces and prints and embosses two fabrics at once, one with each face.

13. A method as claimed in claim 11, performed repetitively, wherein the single element printing-embossing means is made of an absorbent material and contains a sufficient quantity of dye to repeat the printing-embossing operation several times without the need to add new dyestuff and with practically no variance of the shade obtained from print to print.

14. A method as claimed in claim 11, wherein the single element printing-embossing means is a rayon non-woven fabric.

15. A method as claimed in claim 11, wherein the dye deposited into or onto the single element printing-embossing means is levelled by the transit of said sheet or web between two heated elements made in a material having practically no affinity nor permanent retention properties for the dye.

16. A method as claimed in claim 11, wherein the single element printing-embossing means is an endless belt having the dye deposited thereon progressively which advances synchronously with the thermoplastic fabric through a printing and embossing zone.

17. A method as claimed in claim 11, wherein the dye is deposited on one face only of the single element printing-embossing means, while the colour transfer can still take place through both faces.

18. A method as claimed in claim 11, wherein the permeability of the single element printing-embossing means to the gas and vapours of dye is at least partially due to apertures.

19. A method as claimed in claim 11, wherein at least some of the following continuous and successive preparation steps are included:

depositing dye into or onto the single element printing embossing means, drying the dye, and levelling the dye

20. A method as claimed in claim 11, including the successive and continuous transit of the single element printing embossing means through several printing stations and printing and embossing at least one fabric at at least one of said stations.

21. A method as claimed in claim 20, wherein the first two stations are used for drying and for levelling of the dye.

22. A method as claimed in claim 1, wherein sublimable or vapourizable dyestuff is also deposited into or onto the thermoplastic fabric, said dye being permanently fixed into the fabric during the heat transfer operation adding a supplementary colour and/or pattern to it.

23. A method according to claim 11, which comprises the passing of the single element printing embossing means and of the fabric through an apparatus having more than one printing station able to work independently or together, each said station including a thermoprinting calender characterized by two parallel endless belts which advance the heat transfer printing means, the embossing sheet or web and the fabric and which also serve to apply the heat and pressure.

24. A method of printing in color onto a thermoplastic fabric a replica of a first pattern and of simultaneously embossing in relief into the fabric a second pattern without substantially affecting the first pattern as so printed, said method comprising the steps of (a) superposing i. a single element printing-embossing sheet or web bearing a vaporizable or sublimable dye according to said first pattern, the dye having a good affinity for said thermoplastic fabric and for the printing-embossing means itself, said printing-embossing means having in at least one face 2 design in relief according to said second pattern, said relief being created by alternation of raised and hollow portions and/or by apertures in the embossing surface, and ii. a thermoplastic fabric;

(b) applying heat and pressure to the superposed members to cause the transfer by migration of dye in excess from the printing-embossing means onto the thermoplastic fabric and also to cause reproduction in the latter, in relief of said second pattern, the remaining portion of the dye being fixed in the single element printing-embossing sheet or web (c) separating said members one from another.

25. A method according to claim 1 which comprises superposing a porous or foraminous embossing sheet or web.

26. A method according to claim 25 which comprises superposing a filamentary embossing sheet or web.

27. A method according to claim 26 which comprises superposing an embossing sheet or web comprising a major portion of non-polyoleofinic material.

28. A method according to claim 27 which comprises superposing an embossing sheet or web consisting of non-polyoleofinic material.

* * * * *